United States Patent [19]

Nakai et al.

[11] Patent Number: 4,640,635

[45] Date of Patent: Feb. 3, 1987

[54] METHOD FOR INHIBITING PRINTING DURING RIBBON REVERSAL

[75] Inventors: Toshihiko Nakai; Masahiko Kaneko, both of Saitama, Japan

[73] Assignee: Citizen Watch Co., Ltd., Tokyo, Japan

[21] Appl. No.: 684,123

[22] Filed: Dec. 20, 1984

[30] Foreign Application Priority Data

Dec. 28, 1983 [JP] Japan ..... 58-248888

[51] Int. Cl.[4] ..... B41J 29/70

[52] U.S. Cl. ..... 400/664; 400/219.1; 400/225

[58] Field of Search ..... 400/218, 219, 219.1, 400/219.2, 219.3, 219.4, 219.5, 220, 220.1, 220.2, 221, 221.1, 221.2, 222, 225, 238, 239, 249, 663, 664, 665, 666, 667, 668

[56] References Cited

U.S. PATENT DOCUMENTS 674,312 5/1901 Felbel ..... 400/668 X
725,919 4/1903 Barron ..... 400/220.2

FOREIGN PATENT DOCUMENTS 0065584 5/1980 Japan ..... 400/219
0107491 8/1980 Japan ..... 400/219.1
0183282 10/1983 Japan ..... 400/219.1

*Primary Examiner*—Ernest T. Wright, Jr.
*Attorney, Agent, or Firm*—Koda and Androlia

[57] ABSTRACT

A method of feeding an ink ribbon for a printer in which the ink ribbon is frequently reused for printing action by reversing the feeding of the ribbon at the ribbon ends including suppressing the printing action of the printer for a predetermined time at the time of reversing the feeding of the ribbon at the ribbon end to prevent the ink ribbon from excessive use at the ribbon ends to prolong the useful life of the ribbon.

2 Claims, 10 Drawing Figures

METHOD FOR INHIBITING PRINTING DURING RIBBON REVERSAL

BACKGROUND OF THE INVENTION

1. Field of the Invention

This invention relates to a method of feeding an ink ribbon in a printer, and more particularly to an improvement of a method of feeding an ink ribbon in a printer for the purpose of increasing the durability of the ink ribbon which is reversed at the ribbon ends.

2. Description of the Prior Art

In various kinds of printers, especially in impact type printers, printing on the recording paper is performed by striking an ink ribbon which is horizontally arranged along the recording paper, since high printing quality can be easily attained with such a simple structure and at a low price.

As has been well-known, this ink ribbon is driven and fed continually in accordance with the imprinting action and wound on one of the reels provided on both sides of the recording paper or a printing head. Normally, the ink ribbon spanned between the pair of reels is reversed in its feeding direction and continues its frequent use in the imprinting action. Accordingly, the ink ribbon can be effectively used many times.

However, in such a feeding method in the prior art, partial damage to the ink ribbon easily occurs under actual printing conditions. Especially, extreme damage to the small sections in the vicinity of the ribbon ends cause a total abandonment of the ink ribbon despite the fact that the other major portion is sufficiently fit for use. Such problem mentioned above has been more evident in the printer in which the printing speed has been extremely increased in the recent years, and the improvement for prevention of the above drawbacks has been strongly required.

In FIG. 1 shown therein is a damaged state of the ribbon according to the conventional feeding method described above. The ink ribbon 14 spanned between the pair of reels 10 and 12 is used at the hatched portion in the center of the ribbon 14, and is reversed in its motion at its both ends X and Y, as has been well-known, so that the center area can be brought in use for the printing action again.

If such reversing motion of the ribbon 14 were instantly and ideally performed, the ink ribbon 14 could be used with extreme uniformity. However, it is impossible in substance to perform the instant reverse motion of the ribbon 14, and it is inevitable in the recent printers with a high speed ribbon feeding system that the ink ribbon 14 does not follow the rotation of a feeding motor and becomes loose at its ends in the reverse motion.

In the conventional method of feeding the ink ribbon it makes temporary stops or loose in its reverse motion, as is mentioned above, but continuous imprinting action is performed during its reversing motion since the imprinting action on the printer has been paid no attention to. In FIG. 1 shown therein is such a case that the repeating use of the same place for the frequent imprints in the vicinity of the ribbon ends X and Y cause excessive use of the ink ribbon 14, which accelerates damages so rapidly that unfavorable ribbon tear accidentally occurs in the extreme case. Such excessive use in the particular sections also causes such serious imprint failure that this ink ribbon must be abandoned despite the fact that the center area can be still sufficiently fit for use and the maintenance cost will be greatly increased.

SUMMARY OF THE INVENTION

Accordingly, it is an object of the present invention to provide an improved ribbon feeding method which firmly prevents an ink ribbon from sectional excess use in the vicinity of the ribbon ends during ribbon feed reversal so that uniform use of the ribbon can achieve longer life of the ink ribbon.

In keeping with the principle of the present invention, the object is accomplished with a method of feeding an ink ribbon for a printer in which the imprinting action of the printer is temporarily suppressed during ribbon feed reversal at an end of the ink ribbon, while the ink ribbon feeding is stabilized during reversal, so that the uniform use of the ribbon can be easily carried out.

DETAILED DESCRIPTION OF THE EMBODIMENTS

Figure 2:
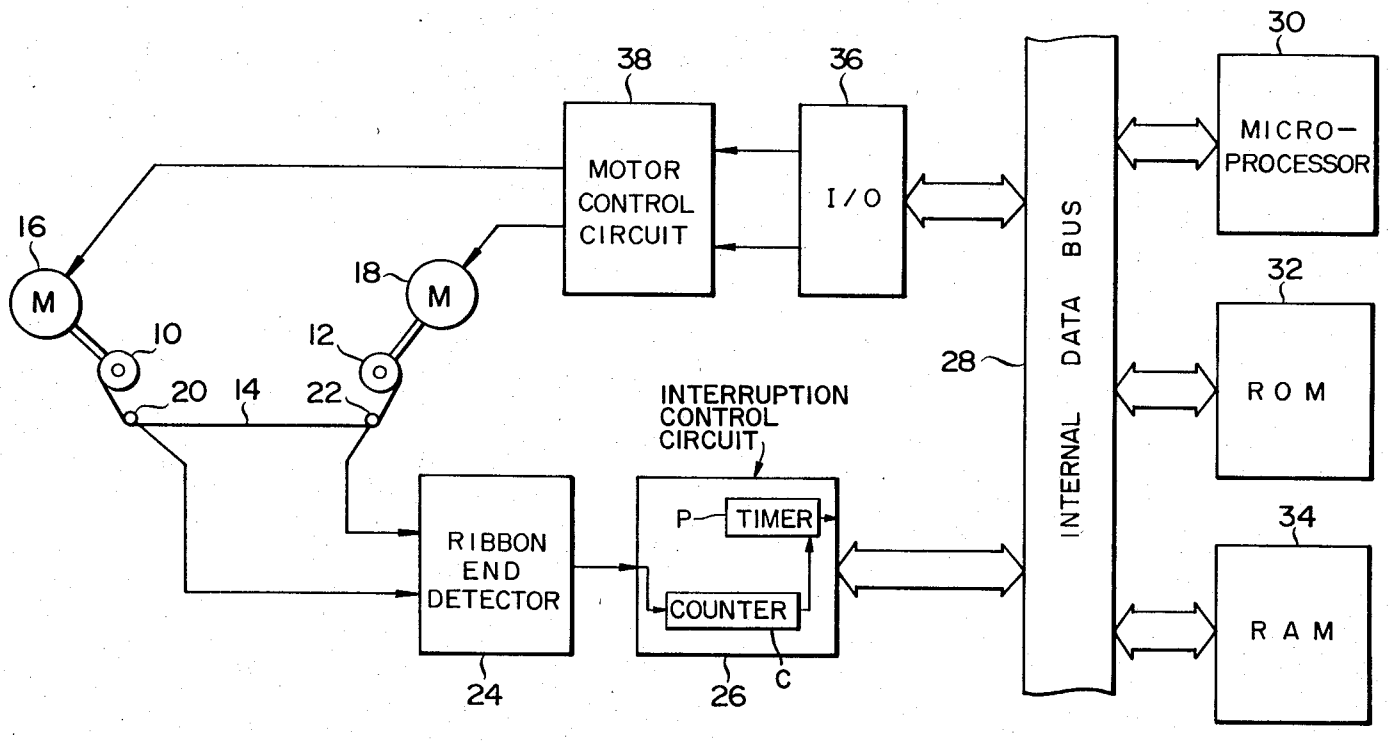
FIG. 2 is an illustration briefly showing a ribbon feeding device for a printer applying an ink ribbon feeding method in accordance with the teachings of the present invention.

Referring more particularly to the drawings, FIG. 2 is a schematic illustration showing a composition of a ribbon feeding control device for a printer in accordance with the teachings of the present invention. A pair of reels 10 and 12 for winding up an ink ribbon 14 are selectively driven and rotated by each of motors 16 and 18 so that the ink ribbon 14 can be fed in either the right or left direction.

In order to detect the ribbon ends of the ink ribbon 14 mentioned above ribbon end sensors 20 and 22 are arranged in the vicinity of those two reels 10 and 12, and the outputs of these two sensors 20 and 22 are supplied to a ribbon end detector 24. The detecting signal output from the ribbon end detector 24 is led through an interruption control circuit 26 to an internal data bus 28 of the printer to indicate a required interruptive routine to the imprinting action of the printer, and the ribbon feeding method is carried out in accordance with the teachings of the present invention. Naturally, connected to the internal data bus 28 are a microprocessor 30, a ROM 32 and a RAM 34, and the desired printing control is activated by the computer process, as has been well-known.

On the other hand, a motor control circuit 38 is connected to the internal data bus 28 through an I/O port 36 in order to control those two motors 16 and 18 mentioned above, and the ink ribbon 14 is controlled to be run and to be reversed.

Figure 3B:
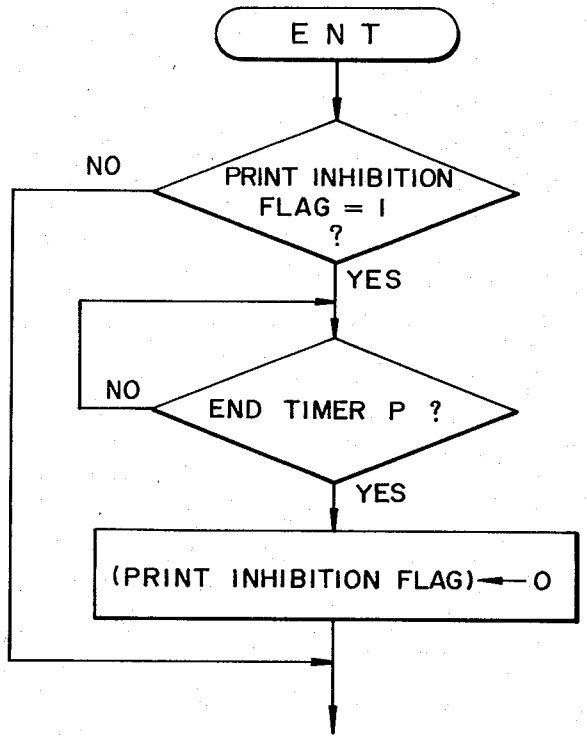
FIG. 3(A) and 3(B) are flow charts showing the first preferred embodiment of the ink ribbon feeding method in accordance with the teachings of the present invention.
Figure 3A:
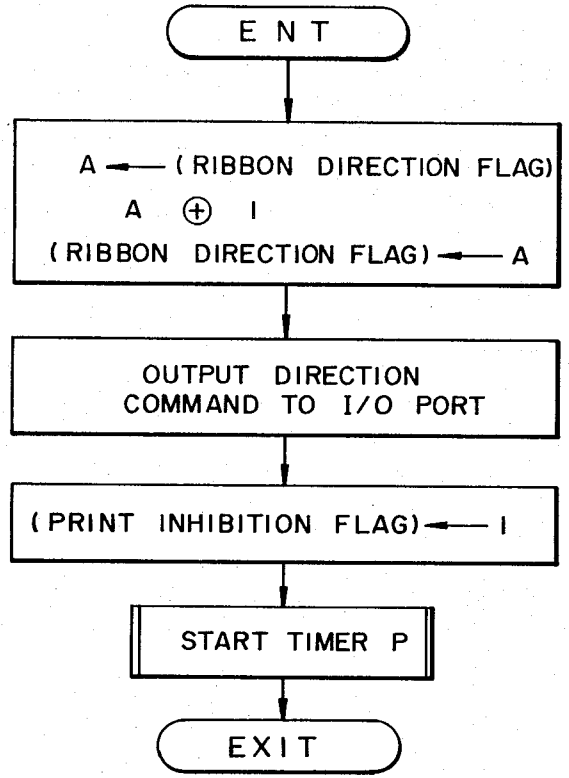

FIGS. 3(A) and 3(B) show the first embodiment of the present invention.

FIG. 3(A) shows the interruptive routine at the time when either one of the ribbon ends of the ink ribbon 14 is detected by the sensor 20 or 22. The ribbon end detector 24 indicates an execution of the routine shown in FIG. 2 through the interruption control circuit 26.

The ribbon end detector 24 detects the current ribbon feeding direction based on the outputs from those two sensors 20 and 22 and memorizes the ribbon direction flag as A. Furthermore, when the ribbon end signal is detected from either one of the sensors 20 or 22 at the time of reverse motion of the ink ribbon 14, the interruptive routine mentioned above is not only started but also the reverse signal "1" is added to the ribbon direction flag A also mentioned above. The new ribbon direction flag or the reverse signal is thus established, and the data are processed by the microprocessor 30. At the same time when the direction reversing motion is detected as is mentioned above, the microprocessor 30 outputs a direction reversing command to the I/O port 36 through the internal data bus 28. The motor control circuit 38, therefore, switches the motors 16 and 18 with the basis of such direction reversing command to have the ink ribbon 14 start the predetermined reverse feeding motion.

Moreover, the interruptive routine establishes an imprint inhibition flag as "1", which is memorized in the RAM 34 or a register of the microprocessor 30.

The present invention is characterized in that the interruptive routine further includes start of a timer P which starts counting a fixed time after the reverse motion of the ink ribbon 14 is detected. The timer P itself is part of the interruption control circuit 26 shown in FIG. 2.

As mentioned hereinabove, at the same time when the ribbon feeding action is controlled, as shown in FIG. 3(B), the imprinting action is suppressed during such reverse motion of the ribbon 14, which is characterized in the present invention. In the first embodiment, the suppression is accomplished by an inhibition of the imprinting action during the counting time of the timer P mentioned above.

In other words, in the printing action the imprint inhibition flag is continuously supervised. The imprinting action is performed on the basis of a well-known host computer command other than during ribbon feed reversal, the imprint inhibition flag is "0" in other words, but during ribbon feed reversal the counting state of the timer P is controlled as shown in FIGS. 3(A) and 3(B), and the imprinting action of the printer is inhibited until completion of predetermined timer counting, while the imprint inhibition flag is "1". Upon completion of counting by the timer P the imprint inhibition flag is switched to "0" and returns to the normal imprinting state.

Figure 1:
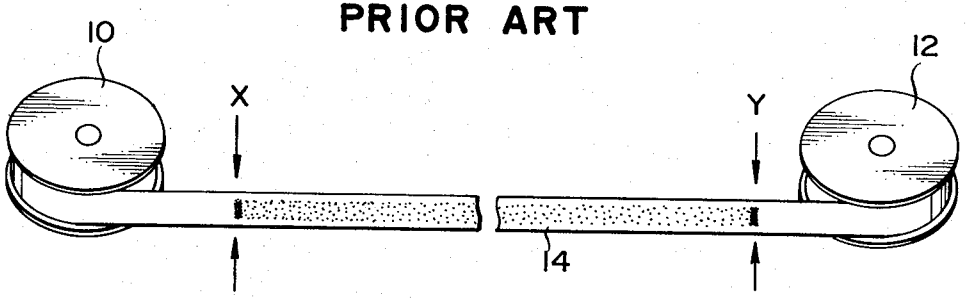
FIG. 1 PRIOR ART
FIG. 1 is an illustration showing using conditions of an ink ribbon in the prior art devices.
Figure 4:
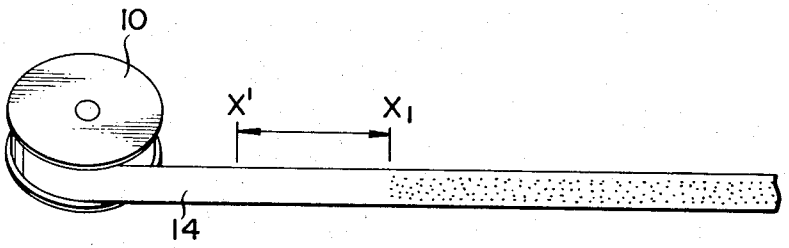
FIG. 4 is an illustration showing the using conditions of the ink ribbon in the first embodiment.

Therefore, according to the first embodiment, as shown in FIG. 4, the ink ribbon 14 is moved to $X_1$, as shown in FIG. 4, during a time from a reverse motion timing X' until the timer P sets a predetermined time period. In this embodiment, at this place $X_1$ the ink ribbon 14 is already put in the stabilized state of ribbon feeding without having a temporary stop and looseness in the ribbon feeding which occur in the prior art method, and the imprinting action is performed to the ink ribbon 14 as uniformly as is seen in the other portion so that the sectional excessive use occurring in the prior art device can be easily avoided and the uniform use of the ribbon 14 can remarkably extend its life. Accordingly, it becomes possible to firmly prevent from such an uneconomical conduct that the ribbon 14 must be abandoned due to the sectional damage as is seen in the prior art method despite the fact that other areas can be still useable.

In this embodiment, the counting time of the timer P is fixed to 500 milliseconds, and experiment shows that the ribbon 14 can veer to the fully stabilized feeding state during such fixed idle feeding time, and the loss of the imprinting time can be almost ignored.

Figure 5:
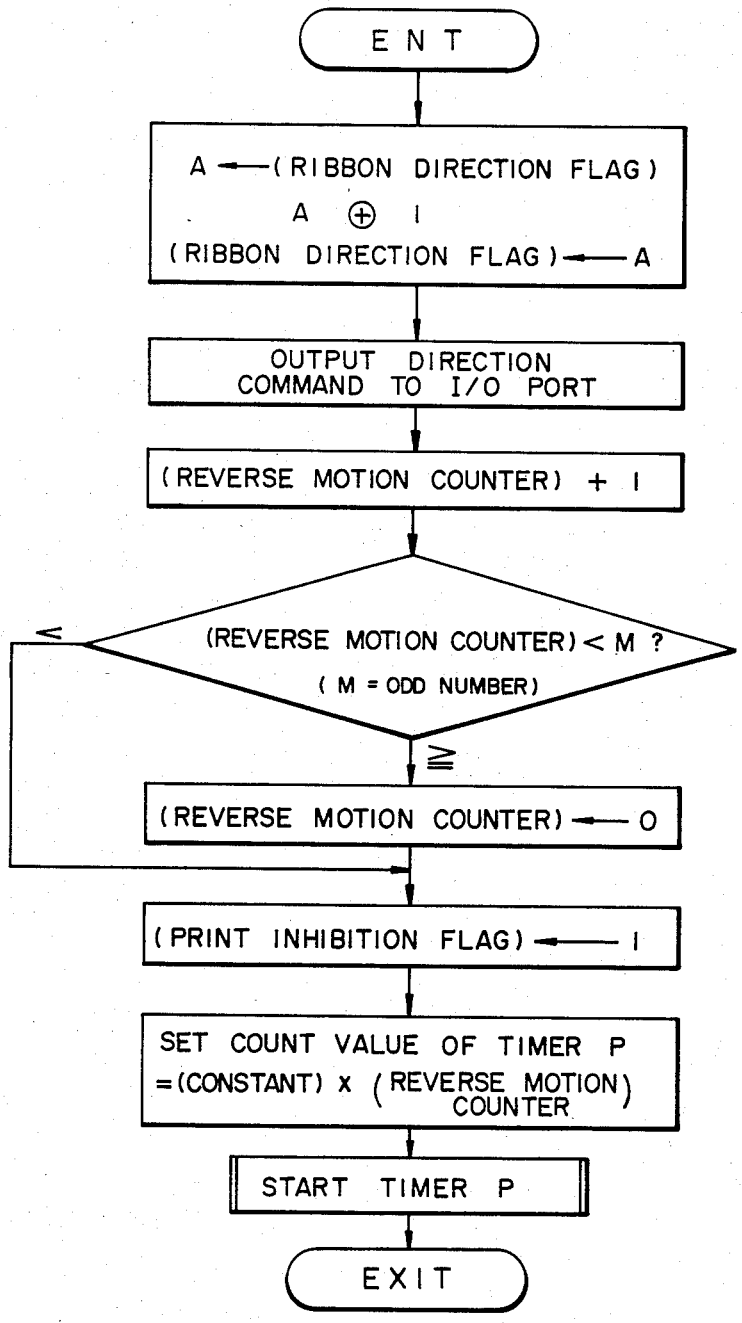
FIG. 5 is a flow chart showing the second embodiment of the present invention.

In FIG. 5 shown therein is the second embodiment of the present invention and only illustrated is the interruptive routine by the interruption control circuit 26. The description is omitted on the imprinting action which is in the same manner as the first embodiment shown in FIG. 3(B).

In the first embodiment since the idle feeding time is limited to a fixed value by the timer P, the imprinting action can be started with the fully stabilized feeding state of the ribbon 14 at the time of reverse motion. However, as shown in FIG. 4, the imprint action is always started with the same fixed position $X_1$, and a border is sharply made between the area of the ribbon 14 used for imprints and the ends of the ribbon 14 not utilized for the imprinting action. When the degree of wear in the ribbon 14 extremely differs in the adjacent position in such a way mentioned above, there will be the case that the ribbon 14 gets torn or damaged at this adjacent position $X_1$. Although the ribbon 14 is used more efficiently in the first embodiment than the one in the prior art method, there exists a problem of ribbon tear at this position.

In order to avoid this problem, in the second embodiment, the counting time of the timer P is controlled to be switched into various times at every ribbon feed reversal so that the border between the used and the non-used areas of the ink ribbon 14 is not distinct. Thus, the ribbon 14 can be prevented from being cut at this position $X_1$.

In other words, as evident from FIG. 5, the interruptive routine at the time of reverse motion of the ribbon 14 includes counting up a reverse motion counter C, which is preferable to the preparation for a plurality of counting times in the timer P and counts up "1" each at every reverse motion of the ink ribbon 14. The reverse motion counter is contained within the interruption control circuit 26 shown in FIG. 2. Its count value is limited to the maximum M and returns to "0" when it counts up to M. The count is repeated between O and M. Furthermore, the establishment of this maximum value M into an odd number can alternatively switch the count value of the timer P at the time of reverse motion on the right and the left sides, and can effectively make the border previously described to be less distinct.

Moreover, the contents of the reverse motion counter C is used as a multiplication value to be multiplied by a constant when the count value of the timer P is set. Therefore, according to this embodiment, the ink ribbon 14 is fed during ribbon feed reversal different times multiplied as mentioned above.

Figure 6:
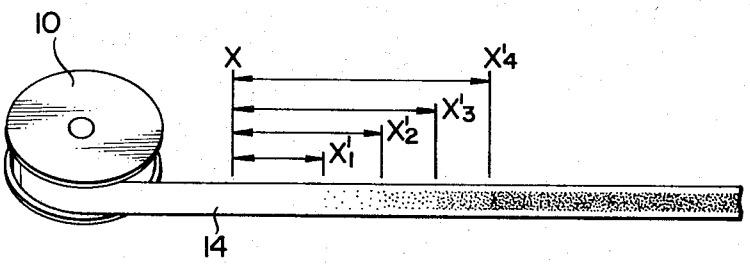
FIG. 6 is an illustration showing the using conditions of the ink ribbon in the second embodiment.

Shown in FIG. 6 is an example wherein established are four kinds of feeding times. The ribbon 14 is fed different feeding times $X'_1$ through $X'_4$ at every ribbon feed reversal so that the ribbon 14 can be fed and used with different using frequencies in steps or at analog change ratios. Accordingly, the border between the used and the non-used areas of the ribbon 14 becomes less distinct, and can be firmly prevented from being cut at this position.

Figure 7B:
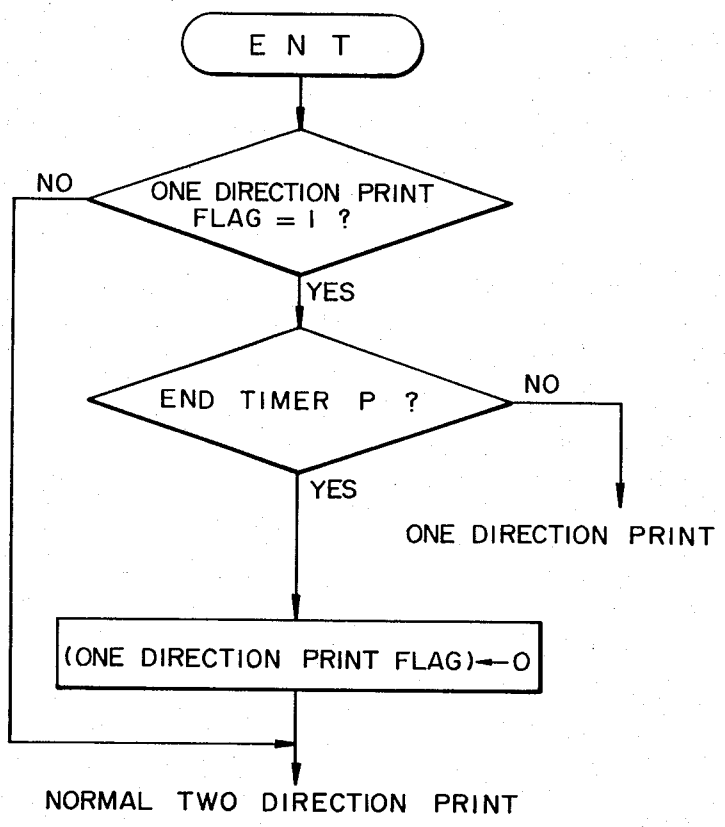
FIGS. 7(A) and 7(B) are flow charts showing the third embodiment of the present invention.
Figure 7A:
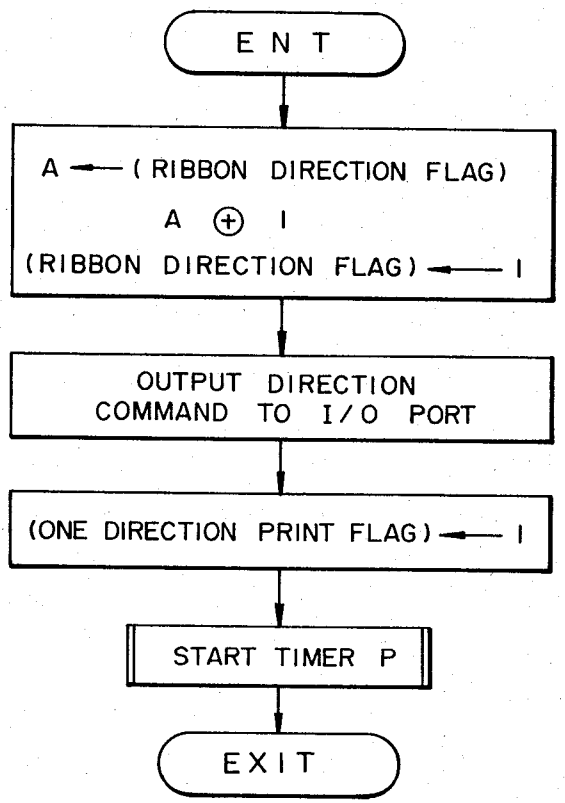

FIGS. 7(A) and 7(B) show the third embodiment of the present invention. In this embodiment, the suppression of imprints at the time of the ink ribbon reverse motion, which is characterized in the present invention, is not composed of the imprint inhibition as is described in the previous embodiments but consists of the decrease of imprinting speed at the ribbon ends.

In other words, the third embodiment applies to a printer having a dot impact printing system capable of one-way and two-way imprints. Normally, a two direction imprint system is performed but in a special case a one direction imprint system is utilized despite the slow imprinting speed.

In the third embodiment, the system is forced to be suppressed only in the one direction imprinting action at the time of reverse motion at the ribbon 14 ends. Accordingly, wear on the ribbon 14 can be decreased at the ribbon ends.

As shown in FIG. 7(A), the interruptive routine includes a process to select the one direction imprint flag as "1" at the time of the reverse motion. In the imprint routine corresponding to the above mentioned, the one direction imprint mode is selected till the end of counting by the timer P when the one direction imprint flag stays at "1", as shown in FIG. 7(B).

Figure 8:
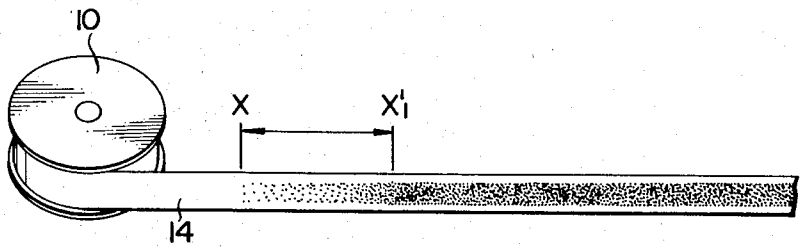
FIG. 8 is an illustration showing the using conditions of the ink ribbon in the third embodiment.

Accordingly, in the third embodiment, as shown in FIG. 8, the using frequency of the ink ribbon 14 is remarkably decreased at the time of ink ribbon 14 reverse motion until a fixed time elapses ($X_1'$) and in substance the total ribbon 14 can be uniformly used.

In the third embodiment, the one direction imprint flag returns to "0" which enables the normal imprinting control of the two direction imprint system after the counting time by the timer P elapses.

As described heretofore, according to the present invention, the imprinting action of the printer is temporarily suppressed at the time of the ink ribbon reverse action, while the ink ribbon 14 is fed, and the imprinting action of the printer is put back in the normal printing condition after the ink ribbon 14 obtains its normal stabilized ribbon feeding state. Therefore, the ink ribbon 14 can be uniformly used all the way through to make it possible to use the ink ribbon 14 for a long life, which is extremely effective for a high speed printer.

What is claimed is:

1. A method of feeding an ink ribbon for a printer in which the ink ribbon is frequently used for imprinting action by the reversal of feeding at the ribbon ends comprising suppressing the imprinting action of the printer for a predetermined time at the end of reversal of feeding at the ribbon ends and changing the suppression time at every reversal of feeding.

2. A method of feeding an ink ribbon for a printer in which the ink ribbon is frequently used for imprinting action by the reversal of feeding at the ribbon ends comprising suppressing the imprinting action of the printer for a predetermined time at the time of reversal of feeding at the ribbon ends and decreasing the imprinting speed for a predetermined time after reversal of feeding of the ink ribbon.

* * * * *